US006962520B2

(12) United States Patent
Taylor

(10) Patent No.: US 6,962,520 B2
(45) Date of Patent: Nov. 8, 2005

(54) RETAINING RINGS, PLANARIZING APPARATUSES INCLUDING RETAINING RINGS, AND METHODS FOR PLANARIZING MICRO-DEVICE WORKPIECES

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/925,417

(22) Filed: Aug. 24, 2004

(65) Prior Publication Data

US 2005/0037694 A1 Feb. 17, 2005

Related U.S. Application Data

(62) Division of application No. 10/191,895, filed on Jul. 8, 2002, now Pat. No. 6,869,335.

(51) Int. Cl.[7] ..... B24B 1/00

(52) U.S. Cl. ..... 451/41; 451/398; 451/397; 451/285; 451/288

(58) Field of Search ..... 451/41, 60, 285–289, 451/397, 398, 402

(56) References Cited

U.S. PATENT DOCUMENTS

| | | | | |
|---|---|---|---|---|
| 5,069,002 | A | | 12/1991 | Sandhu et al. |
| 5,081,796 | A | | 1/1992 | Schultz |
| 5,232,875 | A | | 8/1993 | Tuttle et al. |
| 5,234,867 | A | | 8/1993 | Schultz et al. |
| 5,240,552 | A | | 8/1993 | Yu et al. |
| 5,244,534 | A | | 9/1993 | Yu et al. |
| 5,245,790 | A | | 9/1993 | Jerbic |
| 5,245,796 | A | | 9/1993 | Miller et al. |
| RE34,425 | E | | 11/1993 | Schultz |
| 5,421,769 | A | | 6/1995 | Schultz et al. |
| 5,433,651 | A | | 7/1995 | Lustig et al. |
| 5,449,314 | A | | 9/1995 | Meikle et al. |
| 5,486,129 | A | | 1/1996 | Sandhu et al. |
| 5,514,245 | A | | 5/1996 | Doan et al. |
| 5,533,924 | A | | 7/1996 | Stroupe et al. |
| 5,540,810 | A | | 7/1996 | Sandhu et al. |
| 5,618,381 | A | | 4/1997 | Doan et al. |
| 5,643,060 | A | | 7/1997 | Sandhu et al. |
| 5,658,183 | A | | 8/1997 | Sandhu et al. |
| 5,658,190 | A | | 8/1997 | Wright et al. |
| 5,664,988 | A | | 9/1997 | Stroupe et al. |
| 5,679,065 | A | | 10/1997 | Henderson |
| 5,695,392 | A | * | 12/1997 | Kim ..... 451/288 |
| 5,702,292 | A | | 12/1997 | Brunelli et al. |
| 5,730,642 | A | | 3/1998 | Sandhu et al. |
| 5,747,386 | A | | 5/1998 | Moore |

(Continued)

OTHER PUBLICATIONS

Kondo, Seiichi, et al., "Abrasive–Free Polishing for Copper Damascene Interconnection," Journal of the Electrochemical Society, vol. 147, No. 10, pp. 3907–3913 (2000).

*Primary Examiner*—George Nguyen
(74) *Attorney, Agent, or Firm*—Perkins Coie LLP

(57) ABSTRACT

Retaining rings, planarizing apparatuses including retaining rings, and methods for mechanical and/or chemical-mechanical planarization of micro-device workpieces are disclosed herein. In one embodiment, a carrier head for retaining a micro-device workpiece during mechanical or chemical-mechanical polishing includes a workpiece holder configured to receive the workpiece and a retaining ring carried by the workpiece holder. The retaining ring includes an inner surface, an outer surface, a first surface between the inner surface and the outer surface, and a plurality of grooves in the first surface extending from the inner surface to the outer surface. The grooves include at least a first groove and a second groove positioned adjacent and at least substantially transverse to the first groove.

29 Claims, 5 Drawing Sheets

U.S. PATENT DOCUMENTS 5,792,709 A 8/1998 Robinson et al.
5,795,495 A 8/1998 Meikle
5,807,165 A 9/1998 Uzoh et al.
5,830,806 A 11/1998 Hudson et al.
5,851,135 A 12/1998 Sandhu et al.
5,868,896 A 2/1999 Robinson et al.
5,882,248 A 3/1999 Wright et al.
5,893,754 A 4/1999 Robinson et al.
5,895,550 A 4/1999 Andreas
5,930,699 A 7/1999 Bhatia
5,935,980 A 8/1999 Imperato
5,944,593 A * 8/1999 Chiu et al. ..... 451/442
5,945,347 A 8/1999 Wright
5,954,912 A 9/1999 Moore
5,967,030 A 10/1999 Blalock
5,972,792 A 10/1999 Hudson
5,980,363 A 11/1999 Meikle et al.
5,981,396 A 11/1999 Robinson et al.
5,994,224 A 11/1999 Sandhu et al.
5,997,384 A 12/1999 Blalock
6,004,193 A * 12/1999 Nagahara et al. ..... 451/285
6,039,633 A 3/2000 Chopra
6,040,245 A 3/2000 Sandhu et al.
6,054,015 A 4/2000 Brunelli et al.
6,066,030 A 5/2000 Uzoh
6,074,286 A 6/2000 Ball
6,083,085 A 7/2000 Lankford
6,110,820 A 8/2000 Sandhu et al.
6,116,988 A 9/2000 Ball
6,120,354 A 9/2000 Koos et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,180,525 B1 1/2001 Morgan
6,183,350 B1 * 2/2001 Lin et al. ..... 451/41
6,187,681 B1 2/2001 Moore
6,191,037 B1 2/2001 Robinson et al.
6,193,588 B1 2/2001 Carlson et al.
6,200,901 B1 3/2001 Hudson et al.
6,203,404 B1 3/2001 Joslyn et al.
6,203,413 B1 3/2001 Skrovan
6,206,756 B1 3/2001 Chopra et al.
6,210,257 B1 4/2001 Carlson
6,213,845 B1 4/2001 Elledge
6,218,316 B1 4/2001 Marsh
6,224,472 B1 * 5/2001 Lai et al. ..... 451/398
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,250,994 B1 6/2001 Chopra et al.
6,251,785 B1 6/2001 Wright
6,261,151 B1 7/2001 Sandhu et al.
6,261,163 B1 7/2001 Walker et al.
6,267,643 B1 * 7/2001 Teng et al. ..... 451/41
6,267,650 B1 7/2001 Hembree
6,267,655 B1 7/2001 Weldon et al.
6,273,786 B1 8/2001 Chopra et al.
6,273,796 B1 8/2001 Moore
6,276,996 B1 8/2001 Chopra
6,284,660 B1 9/2001 Doan
6,306,012 B1 10/2001 Sabde
6,306,014 B1 10/2001 Walker et al.
6,306,768 B1 10/2001 Klein
6,312,558 B2 11/2001 Moore
6,328,632 B1 12/2001 Chopra
6,331,488 B1 12/2001 Doan et al.
6,350,180 B2 2/2002 Southwick
6,350,691 B1 2/2002 Lankford
6,352,466 B1 3/2002 Moore
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,447,380 B1 * 9/2002 Pham et al. ..... 451/288
6,648,734 B2 * 11/2003 Chin et al. ..... 451/41
2004/0018804 A1 1/2004 Taylor

* cited by examiner

RETAINING RINGS, PLANARIZING APPARATUSES INCLUDING RETAINING RINGS, AND METHODS FOR PLANARIZING MICRO-DEVICE WORKPIECES

This application is a divisional of U.S. application Ser. No. 10/191,895, entitled RETAINING RINGS, PLANARIZING APPARATUSES INCLUDING RETAINING RINGS, AND METHODS FOR PLANARIZING MICRO-DEVICE WORKPIECES," filed Jul. 8, 2002, now U.S. Pat. No. 6,869,335, issued Mar. 22, 2005, which is herein incorporated by reference in its entirety.

TECHNICAL FIELD

The present invention relates to retaining rings, planarizing machines, and methods for mechanical and/or chemical-mechanical planarization of micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow l).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier head 30 presses the workpiece 12 face-downward against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12. The force generated by friction between the micro-device workpiece 12 and the planarizing pad 40 will, at any given instant, be exerted across the surface of the workpiece 12 primarily in the direction of the relative movement between the workpiece 12 and the planarizing pad 40. A retaining ring 33 can be used to counter this force and hold the micro-device workpiece 12 in position. The frictional force drives the micro-device workpiece 12 against the retaining ring 33, which exerts a counterbalancing force to maintain the workpiece 12 in position.

The planarity of the finished micro-device workpiece surface is a function of the distribution of planarizing solution 44 under the workpiece 12 during planarization and several other factors. The distribution of planarizing solution 44 is a controlling factor for the distribution of abrasive particles and chemicals under the workpiece 12, as well as a factor affecting the temperature distribution across the workpiece 12. In certain applications it is difficult to control the distribution of planarizing solution 44 under the micro-device workpiece 12 because the retaining ring 33 wipes some of the solution 44 off of the planarizing pad 40. Moreover, the retaining ring 33 can prevent proper exhaustion of the planarizing solution 44 from inside the retaining ring 33, causing a build-up of the planarizing solution 44 proximate to the trailing edge. These problems cause an uneven distribution of abrasive particles and chemicals under the micro-device workpiece that results in non-uniform and uncontrollable polishing rates across the workpiece. To solve this problem, some retaining rings have grooves. These retaining rings, however, have not been very effective at exhausting the planarizing solution.

FIG. 2 schematically illustrates another rotary CMP machine 110 with a first platen 120*a*, a second platen 120*b*, a first carrier head 130*a*, and a second carrier head 130*b*. On the CMP machine 110, the first carrier head 130*a* rotates in a first direction $D_1$, and the second carrier head 130*b* rotates in a second direction $D_2$. Because the carrier heads 130*a–b* rotate in different directions, retaining rings with different grooves are used for each carrier head 130*a–b*. The use of two different retaining rings increases inventory costs and can result in the wrong ring being placed on a carrier head 130.

SUMMARY

The present invention relates to retaining rings, planarizing apparatuses including retaining rings, and methods for mechanical and/or chemical-mechanical planarization of micro-device workpieces. In one embodiment, a carrier head for retaining a micro-device workpiece during mechanical or chemical-mechanical polishing includes a workpiece holder configured to receive the workpiece and a retaining ring carried by the workpiece holder. The retaining ring includes an inner surface, an outer surface, and a first surface between the inner surface and the outer surface. The retaining ring has a plurality of grooves in the first surface that extend from the inner surface to the outer surface. The grooves include at least a first groove and a second groove. The second groove is positioned adjacent to and/or intersects the first groove, and the second groove is at least substantially transverse to the first groove.

In another embodiment, a carrier head for retaining a micro-device workpiece during rotation in a solution includes a workpiece holder configured to receive the workpiece and a retaining ring carried by the workpiece holder. The retaining ring includes an inner wall, an outer wall, and a first surface between the inner wall and the outer wall. The first surface has a first plurality of channels and a second plurality of channels. The first and second plurality of channels extend from the inner wall to the outer wall. The first plurality of channels is configured to pump the solution into the retaining ring when the retaining ring is rotated in a first direction. The second plurality of channels is configured to exhaust the solution from the retaining ring when the retaining ring is rotated in the first direction.

In an additional embodiment, a carrier head for retaining a micro-device workpiece during rotation in a solution includes a workpiece holder configured to receive the workpiece and a retaining ring carried by the workpiece holder. The retaining ring is configured to flow the solution into the retaining ring when the retaining ring is rotated in a first direction, and also when the retaining ring is rotated in a second direction opposite the first direction. In another embodiment, the retaining ring can include an inner surface, an outer surface, and a first surface between the inner surface and the outer surface. The first surface has a means for pumping the solution into the retaining ring and a means for exhausting the solution from the retaining ring when the retaining ring is rotated in the a single direction.

An embodiment of a polishing machine for mechanical or chemical-mechanical polishing of micro-device workpieces includes a table having a support surface, a planarizing pad coupled to the support surface of the table, and a workpiece carrier assembly including a carrier head with a retaining ring and a drive system coupled to the carrier head. The retaining ring has an inner surface, an outer surface, and a first surface between the inner surface and the outer surface. The first surface has a first groove and a second groove positioned at least substantially transverse to the first groove. The first and second grooves extend from the inner surface to the outer surface. The carrier head is configured to hold the workpiece, and the drive system is configured to move the carrier head to engage the workpiece with the planarizing pad. The carrier head and/or the table is movable relative to the other to rub the workpiece against the planarizing pad.

An embodiment of a method for polishing a micro-device workpiece includes retaining the workpiece with a retaining ring, rotating the retaining ring relative to a polishing pad in a first direction, passing a solution into the retaining ring through at least a first groove, and exhausting the solution from the retaining ring through at least a second groove. The first groove has a first orientation in the retaining ring, and the second groove has a second orientation at least substantially transverse to the first orientation in the retaining ring.

An embodiment of a method for mounting a retaining ring on a polishing machine includes mounting a first retaining ring on a first carrier head that rotates in a first direction and attaching a second retaining ring to a second carrier head that rotates in a second direction opposite the first direction. The second retaining ring is identical to the first retaining ring. The method further includes flowing fluid through the first and second retaining rings.

DETAILED DESCRIPTION

The present invention is directed to retaining rings, planarizing apparatuses including retaining rings, and to methods for mechanical and/or chemical-mechanical planarization of micro-device workpieces. The term "micro-device workpiece" is used throughout to include substrates upon which and/or in which microelectronic devices, micromechanical devices, data storage elements, and other features are fabricated. For example, micro-device workpieces can be semi-conductor wafers, glass substrates, insulative substrates, or many other types of substrates. Furthermore, the terms "planarization" and "planarizing" mean either forming a planer surface and/or forming a smooth surface (e.g., "polishing"). Moreover, the term "transverse" means oblique, perpendicular, and/or not parallel. Several specific details of the invention are set forth in the following description and in FIGS. 3–8 to provide a thorough understanding of certain embodiments of the invention. One skilled in the art, however, will understand that the present invention may have additional embodiments, or that other embodiments of the invention may be practiced without several of the specific features explained in the following description.

Figure 1:
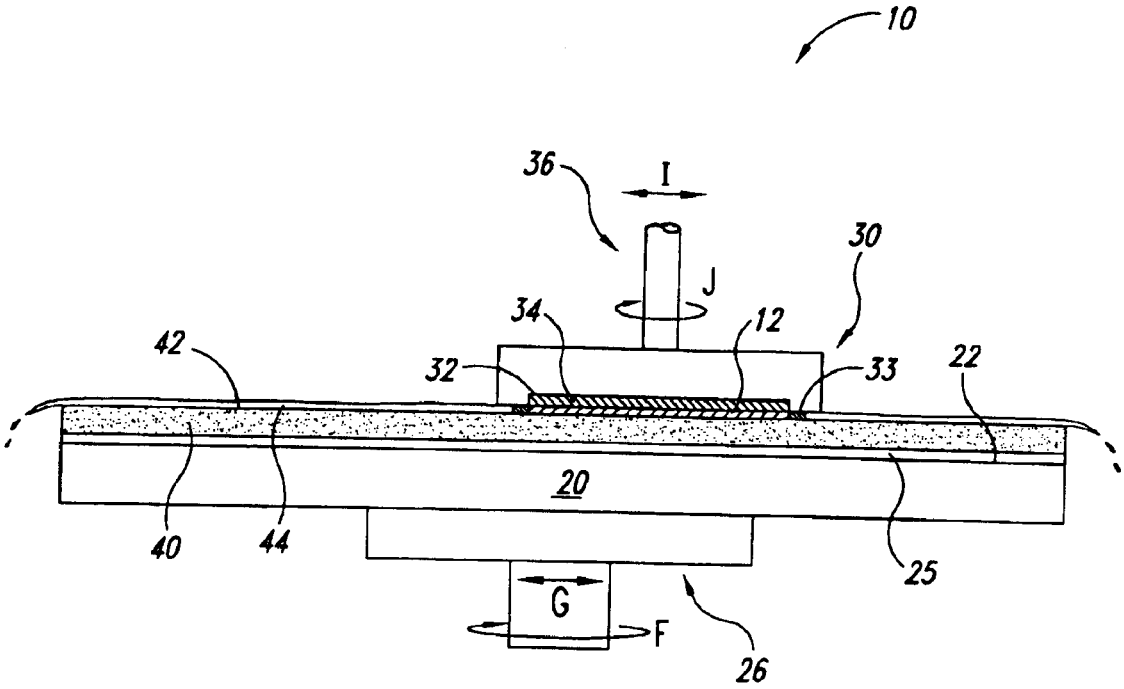
Fig. 1 (Prior Art)
FIG. 1 is a schematic cross-sectional view illustrating a portion of a rotary planarizing machine in accordance with the prior art.
Figure 3A:
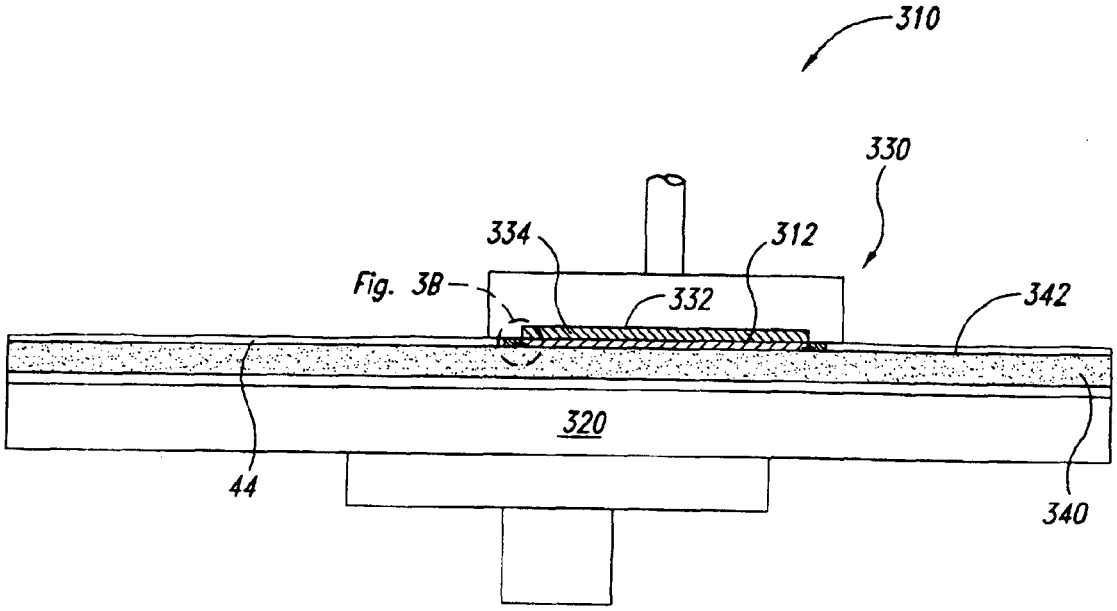
FIG. 3A is a schematic cross-sectional view illustrating a portion of a rotary planarizing machine with a workpiece carrier having a retaining ring in accordance with one embodiment of the invention.

FIG. 3A schematically illustrates a rotary CMP machine 310 with a table such as a platen 320, a workpiece holder such as a workpiece carrier 330, and a planarizing pad 340. The platen 320 and the pad 340 can be similar to the platen 20 and the pad 40 described above with reference to FIG. 1. The pad 340, for example, can have a planarizing surface 342 upon which a micro-device workpiece 312 is planarized in the presence of a slurry or another type of planarizing solution 44. The platen 320 can be stationary or it can be a rotary platen.

In the illustrated embodiment, the workpiece carrier 330 has a lower surface 332 to which a backing member 334 is attached. The backing member 334 can be configured to selectively exert a downward force on a micro-device workpiece 312 during planarization. The micro-device workpiece 312 is positioned between the backing member 334 and the planarizing pad 340. In alternative embodiments, the workpiece carrier 330 may not include the backing member 334. The workpiece carrier 330 also has a retaining ring 333 to prevent the micro-device workpiece 312 from slipping relative to the workpiece carrier 330. The retaining ring 333 circumscribes the micro-device workpiece 312 to retain the workpiece 312 in the proper position below the lower surface 332 as the workpiece carrier 330 rubs the workpiece 312 against the pad 340. The retaining ring 333 can have a greater diameter than the micro-device workpiece 312 to allow the workpiece 312 to precess relative to the workpiece carrier 330 during the planarizing process.

Figure 3B:
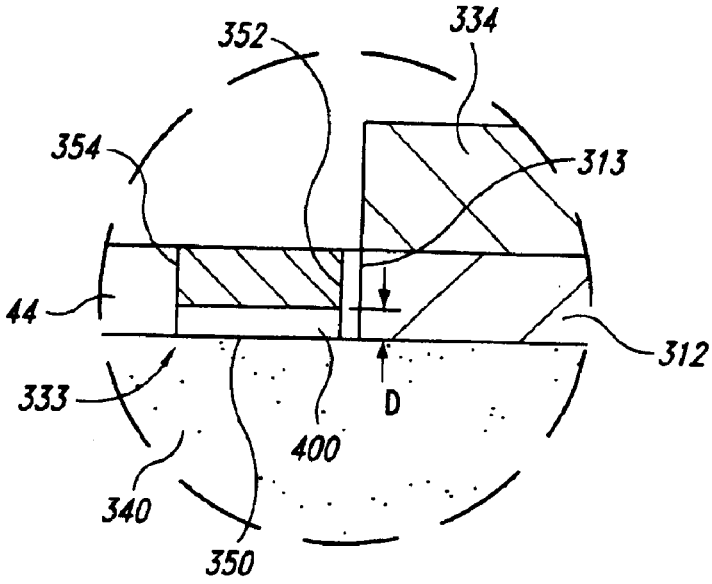
FIG. 3B is a schematic cross-sectional view of the retaining ring of FIG. 3A.

FIG. 3B is a cross-sectional view showing a portion of the retaining ring 333 in greater detail. The retaining ring 333 has an inner annular surface 352, an outer annular surface 354, and a first surface 350 between the inner and outer annular surfaces 352 and 354. An edge 313 of the micro-device workpiece 312 is positioned proximate to the inner annular surface 352 of the retaining ring 333. The inner annular surface 352 can thus exert a force against the edge 313 to retain the workpiece 312 in the proper position. The first surface 350 contacts the planarizing solution 44 and the planarizing pad 340. The outer annular surface 354 and the first surface 350 sweep the planarizing solution 44 across the pad 340, which often prevents the planarizing solution 44 from entering and/or exiting the retaining ring 333.

The retaining ring 333 can have a plurality of grooves 400 (only one groove shown in FIG. 3B) through which the planarizing solution 44 can pass. As explained below, the grooves 400 can allow the planarizing solution 44 to both enter and exit the retaining ring 333.

Figure 2:
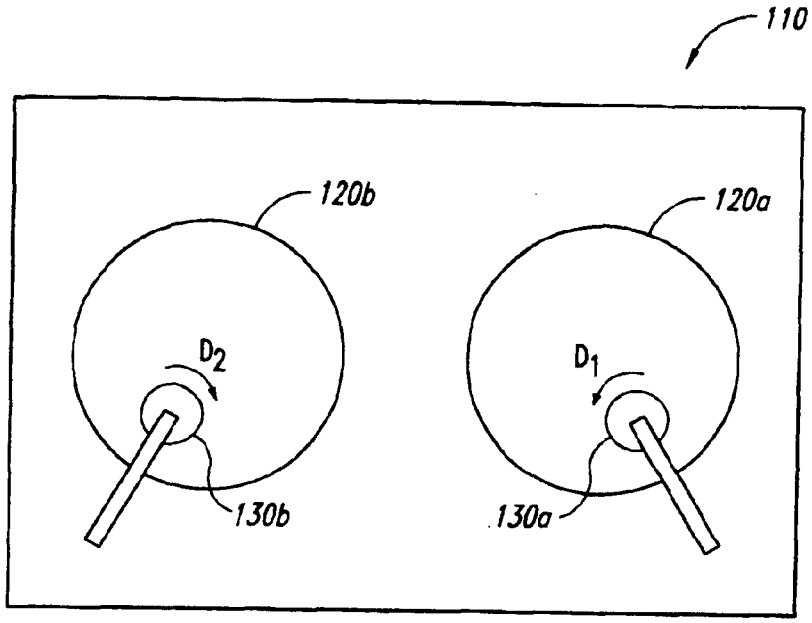
Fig. 2 (Prior Art)
FIG. 2 is a top plan view illustrating a portion of a rotary planarizing machine in accordance with the prior art.
Figure 4:
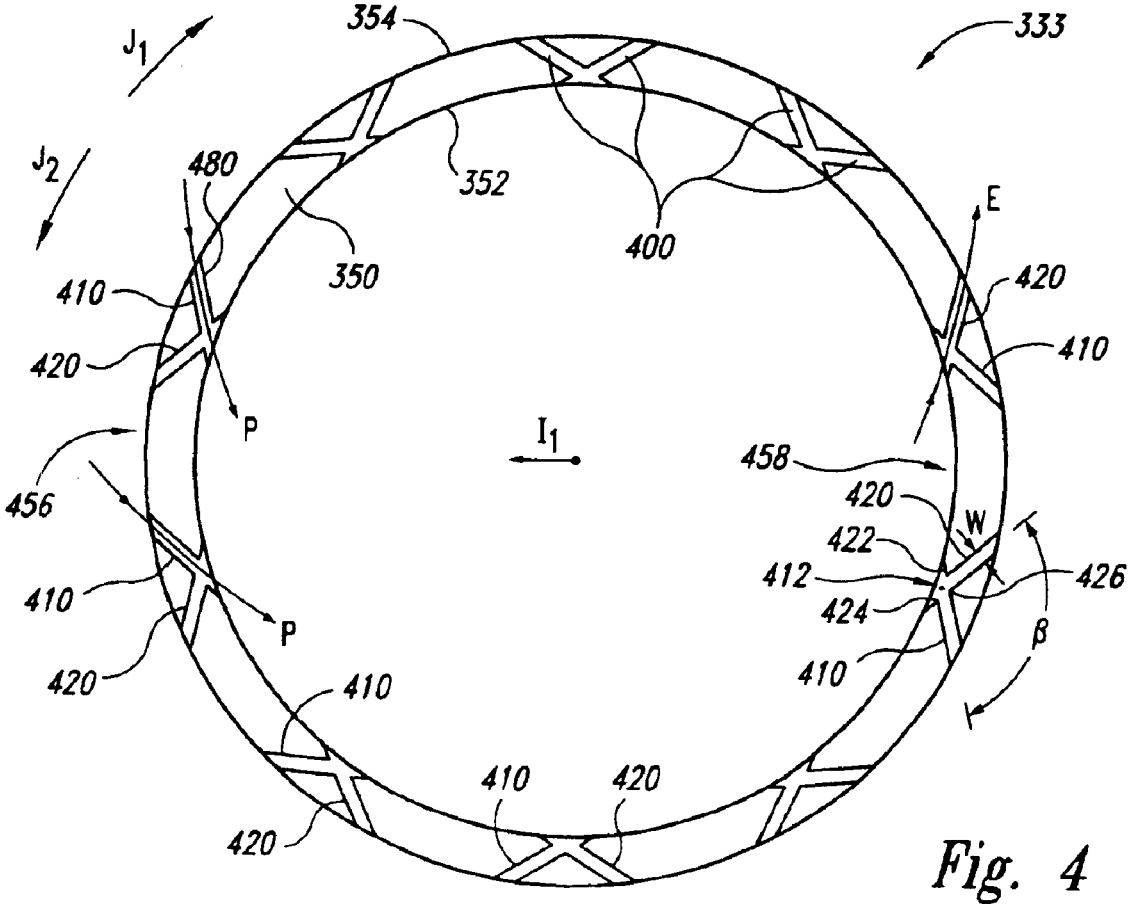
FIG. 4 is a bottom plan view of the retaining ring of FIGS. 3A and 3B.

FIG. 4 is a bottom plan view of an embodiment of the retaining ring 333 of FIGS. 3A and 3B. In the illustrated embodiment, the grooves 400 are spaced apart uniformly around the retaining ring 333. The grooves 400 include a plurality of first grooves 410 and a plurality of second grooves 420 that extend from the outer annular surface 354 to the inner annular surface 352. The first and second grooves 410 and 420 intersect at an angle β at a point of intersection 412 proximate to the inner annular surface 352. In one embodiment, the angle β is approximately 110 degrees. In additional embodiments, the angle β can be equal to or greater than 90 degrees and less than 180 degrees. The first and second grooves 410 and 420 are arranged in pairs that intersect at the same angle. In additional embodiments, some of the groove pairs can have grooves 400 that intersect at different angles. The intersection of the first groove 410 and the second groove 420 creates a first point 422, a second point 424, and a third point 426. Furthermore, the intersection of the first surface 350 and a side wall 480 in the grooves 400 can be beveled or rounded to avoid excessive wear to the planarizing pad 340 (FIG. 2). In the illustrated embodiment, the grooves 400 have a width W of approximately 0.025 inch and a depth D (FIG. 3) of approximately 0.025 inch. In other embodiments, the width W and the depth D of the grooves 400 can be different to provide the desired flow characteristics.

The orientation of the plurality of grooves 400 in the illustrated embodiment prevents the planarizing solution 44 (FIG. 3) from accumulating along the outside of a leading edge 456 and along the inside of a trailing edge 458 of the retaining ring 333 during planarization. For example, as the retaining ring 333 rotates in a direction $J_1$ and moves linearly in a direction $I_1$, the planarizing solution 44 (FIG. 3), including the abrasive particles, flows through the first grooves 410 along the leading edge 456. Accordingly, the orientation of the first grooves 410 at the leading edge 456 causes the planarizing solution 44 (FIG. 3) to flow along paths P and contact the micro-device workpiece 312 (FIG. 3) during the planarizing process. Similarly, the orientation of the second grooves 420 at the trailing edge 458 of the retaining ring 333 allows for proper exhaustion of the planarizing solution 44 (FIG. 3) from inside the retaining ring 333. For example, the planarizing solution 44 (FIG. 3) can pass along path E as the retaining ring 333 rotates in the direction $J_1$ and moves linearly in the direction $I_1$. Accordingly, the orientation of the grooves 400 allows for a more even distribution of the planarizing solution 44 (FIG. 3) during the planarizing process by preventing accumulation of the planarizing solution 44 (FIG. 3) proximate to the outside of the leading edge 456 and the inside of the trailing edge 458 of the retaining ring 333.

Another advantage of this embodiment is that the retaining ring 333 will also function properly when it is rotated in a direction $J_2$. If the retaining ring 333 is rotated in the direction $J_2$, the solution 44 (FIG. 3) flows into the ring 333 through the second grooves 420 and out of the ring 333 through the first grooves 410. Accordingly, the retaining ring 333 can be used on either workpiece carrier in CMP machines that have two platens which rotate in opposite directions. This versatility reduces inventory costs and the likelihood of placing the wrong retaining ring on a workpiece carrier.

Figure 5:
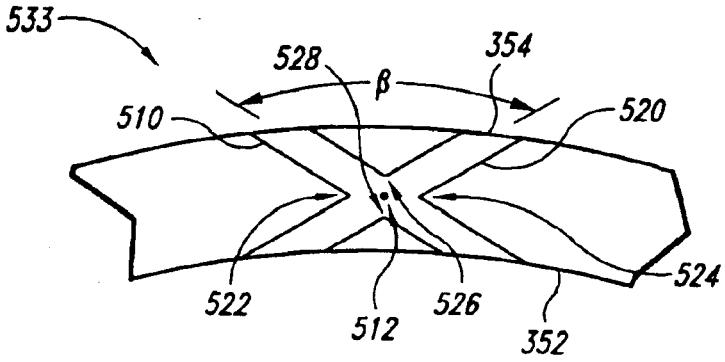
FIG. 5 is a bottom plan view illustrating a portion of a retaining ring in accordance with another embodiment of the invention.

FIG. 5 is a bottom plan view illustrating a portion of a retaining ring 533 in accordance with another embodiment of the invention. The retaining ring 533 has a first groove 510 and a second groove 520 that intersect at an intersection 512 proximate to a midpoint between the outer annular surface 354 and the inner annular surface 352, thereby creating an "X" pattern. The first groove 510 is oriented at the angle β with respect to the second groove 520. The intersection of the first groove 510 and the second groove 520 creates a first point 522, a second point 524, a third point 526, and a fourth point 528. Each of these points 522, 524, 526 and 528 can cause wear on the planarizing pad 340 (FIG. 3) as the retaining ring 333 moves relative to the planarizing pad 340 (FIG. 3) during the planarizing process. Accordingly, one advantage of the embodiment illustrated in FIG. 4 is that the number of points 422, 424 and 426 is reduced from four to three. The retaining ring 533 of the illustrated embodiment can have other similarly oriented grooves, or other grooves with a different orientation spaced around the retaining ring 533.

Figure 6:
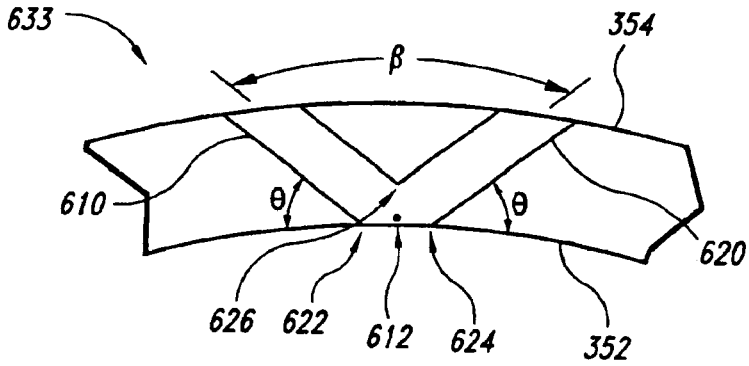
FIG. 6 is a bottom plan view illustrating a portion of a retaining ring in accordance with another embodiment of the invention.

FIG. 6 is a bottom plan view illustrating a portion of a retaining ring 633 in accordance with another embodiment of the invention. The retaining ring 633 has a first groove 610 and a second groove 620 that intersect at an intersection 612 proximate to the inner annular surface 352, thereby creating a "V" pattern. The first groove 610 is oriented at the angle β with respect to the second groove 620. The intersection of the first groove 610 and the second groove 620 creates a first point 622, a second point 624, and a third point 626. An angle θ is formed by the intersection of the first groove 610 and the inner annular surface 352 (at the first point 622), and the intersection of the second groove 620 and the inner annular surface 352 (at the third point 626).

Figure 7:
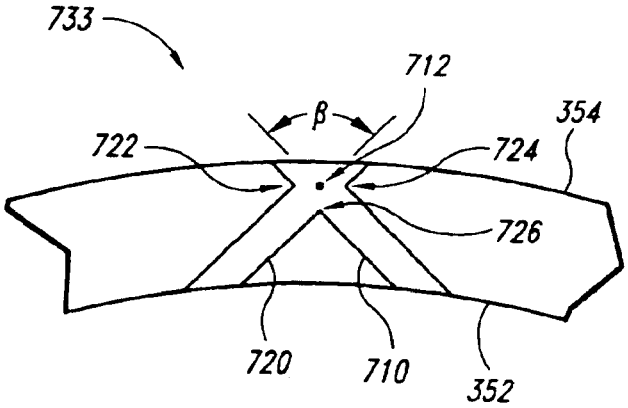
FIG. 7 is a bottom plan view illustrating a portion of a retaining ring in accordance with another embodiment of the invention.

FIG. 7 is a bottom plan view illustrating a portion of a retaining ring 733 in accordance with another embodiment of the invention. The retaining ring 733 includes a first groove 710 and a second groove 720 that intersect at an intersection 712 proximate to the outer annular surface 354, thereby creating a "V" pattern. The first groove 710 is oriented at the angle β with respect to the second groove 720.

Figure 8:
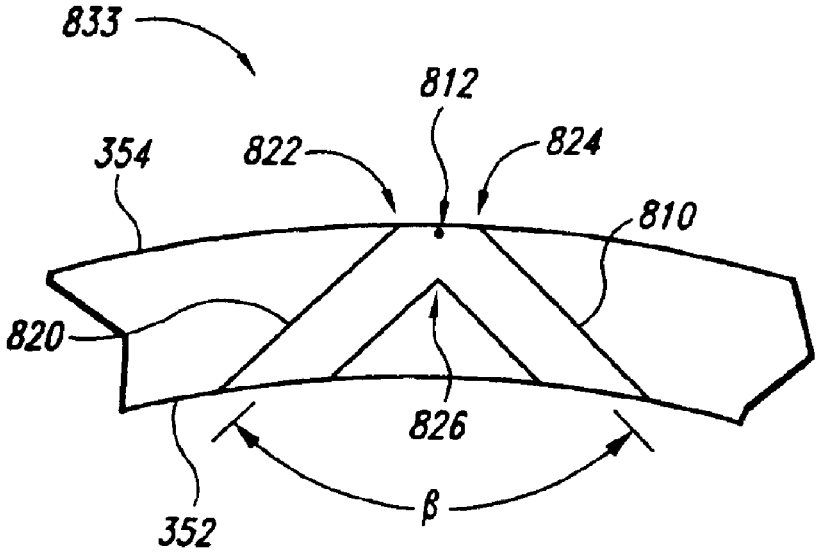
FIG. 8 is a bottom plan view illustrating a portion of a retaining ring in accordance with another embodiment of the invention.

FIG. 8 is a bottom plan view illustrating a portion of a retaining ring 833 in accordance with another embodiment of the invention. The retaining ring 833 includes a first groove 810 and a second groove 820 that intersect at an intersection 812 proximate to the outer annular surface 354. The first groove 810 is oriented at the angle β with respect to the second groove 820.

Figure 9:
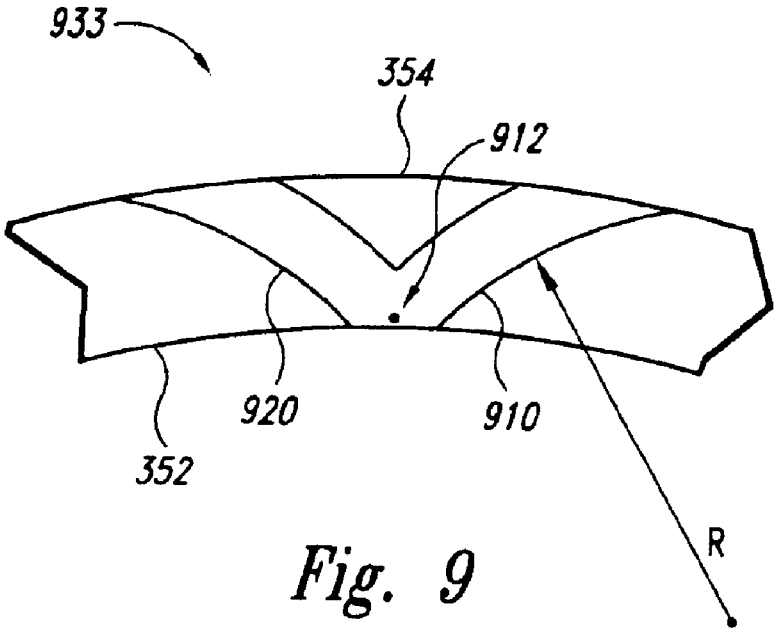
FIG. 9 is a bottom plan view illustrating a portion of a retaining ring in accordance with another embodiment of the invention.

FIG. 9 is a bottom plan view illustrating a portion of a retaining ring 933 in accordance with another embodiment of the invention. The retaining ring 933 includes a first groove 910 and a second groove 920 that intersect at an intersection 912 proximate to the inner annular surface 352, similar to the retaining ring 633 illustrated in FIG. 6. The first and second grooves 910 and 920, however, have a radius of curvature R. In other embodiments, the first and second grooves 910 and 920 may have a more complex curvature. In additional embodiments, grooves in other retaining rings, such as those illustrated in FIGS. 4, 5, 7 and 8, may have curvature.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A carrier head for retaining a micro-device workpiece during mechanical or chemical-mechanical polishing, the carrier head comprising:

a workpiece holder configured to receive the workpiece; and a retaining ring carried by the workpiece holder, the retaining ring including an inner surface, an outer surface, a first surface between the inner surface and the outer surface, and a plurality of grooves in the first surface extending from the inner surface to the outer surface, wherein the grooves include at least a first groove and a second groove positioned adjacent and at least substantially transverse to the first groove, and wherein the first groove intersects the second groove proximate to the outer surface.

2. The carrier head of claim 1 wherein the first groove is positioned at an angle of between 90 and 130 degrees relative to the second groove.

3. The carrier head of claim 1, further comprising a plurality of first grooves and a plurality of second grooves arranged in groove pairs, wherein the individual groove pairs have a first groove and a second groove that are at least substantially transverse to each other.

4. The carrier head of claim 1 wherein at least one of the first and second grooves is straight.

5. The carrier head of claim 1 wherein at least one of the first and second grooves is curved.

6. The carrier head of claim 1 wherein the first groove intersects the second groove creating a "V" pattern.

7. A carrier head for retaining a micro-device workpiece during rotation in a solution, the carrier head comprising:

a workpiece holder configured to receive the workpiece; and a retaining ring carried by the workpiece holder, the retaining ring including an inner wall, an outer wall, and a first surface between the inner wall and the outer wall, the first surface having a first plurality of channels and a second plurality of channels, the first and second plurality of channels extending from the inner wall to the outer wall, the first plurality of channels being configured to pump the solution into the retaining ring when the retaining ring is rotated in a first direction, the second plurality of channels being configured to exhaust the solution from the retaining ring when the retaining ring is rotated in the first direction, and wherein the individual channels in the first plurality of channels intersects a corresponding channels in the second plurality of channels proximate to the outer wall.

8. The carrier head of claim 7 wherein the channels in the first plurality of channels are positioned at an angle of between 90 and 130 degrees relative to corresponding channels in the second plurality of channels.

9. The carrier head of claim 7 wherein at least one of the channels in the first plurality of channels is straight.

10. The carrier head of claim 7 wherein at least one of the channels in the first plurality of channels is curved.

11. The carrier head of claim 7 wherein the channels in the first plurality of channels intersect corresponding channels in the second plurality of channels creating a "V" pattern.

12. A carrier head for retaining a micro-device workpiece during rotation in a solution, the carrier head comprising:

a workpiece holder configured to receive the workpiece; and a retaining ring carried by the workpiece holder, the retaining ring configured to flow the solution through the retaining ring when the retaining ring rotates in a first direction, and the retaining ring configured to flow the solution through the retaining ring when the retaining ring rotates in a second direction opposite the first direction, wherein the retaining ring comprises an outer surface, a first groove, and a second groove that intersects the first groove proximate to the outer surface.

13. The carrier head of claim 12 wherein the first groove is configured to flow the solution into the retaining ring when the retaining ring rotates in the first direction.

14. The carrier head of claim 12 wherein the second groove is configured to flow the solution into the retaining ring when the retaining ring rotates in the second direction.

15. The carrier head of claim 12 wherein the retaining ring is configured to exhaust the solution when the retaining ring rotates in the first direction, and the retaining ring is configured to exhaust the solution when the retaining ring rotates in the second direction.

16. A carrier head for retaining a micro-device workpiece during rotation in a solution, the carrier head comprising:

a workpiece holder configured to receive the workpiece; and a retaining ring carried by the workpiece holder, the retaining ring including an inner surface, an outer surface, a first surface between the inner surface and the outer surface, a means for pumping the solution through the retaining ring, and a means for concurrently exhausting the solution through the retaining ring as the retaining ring rotates in a single direction, wherein the means for pumping comprises a first channel and the means for exhausting comprises a second channel that intersects the first channel proximate to the outer surface.

17. A polishing machine for mechanical or chemical-mechanical polishing of micro-device workpieces, comprising:

a table having a support surface;

a planarizing pad coupled to the support surface of the table; and a workpiece carrier assembly including a carrier head with a retaining ring and a drive system coupled to the carrier head, the retaining ring having an inner surface, an outer surface, a first surface between the inner surface and the outer surface, a first groove, and a second groove positioned at least substantially transverse to the first groove, wherein the first and second grooves are in the first surface and extend from the inner surface to the outer surface, the first groove intersects the second groove proximate to the outer surface, the carrier head is configured to hold the workpiece and the drive system is configured to move the carrier head to engage the workpiece with the planarizing pad, and the carrier head and/or the table is movable relative to the other to rub the workpiece against the planarizing pad.

18. The polishing machine of claim 17 wherein the first groove is positioned at an angle of between 90 and 130 degrees relative to the second groove.

19. The polishing machine of claim 17, further comprising a first plurality of grooves and a second plurality of grooves arranged in groove pairs, wherein the individual grooves in the first plurality of grooves are positioned at least substantially transverse to corresponding grooves in the second plurality of grooves, and the individual grooves in the first and second plurality of grooves extends from the inner surface to the outer surface.

20. A polishing machine for chemical-mechanical polishing of micro-device workpieces with a solution, comprising:

a table having a support surface;

a planarizing pad coupled to the support surface of the table; and a workpiece carrier assembly including a carrier head with a retaining ring and a drive system coupled to the carrier head, the retaining ring including an outer surface, a first groove, and a second groove intersecting the first groove proximate to the outer surface, the retaining ring being configured to flow the solution through the retaining ring when the retaining ring rotates in a first direction, and the retaining ring being configured to flow the solution through the retaining ring when the retaining ring rotates in a second direction opposite the first direction, wherein the carrier head is configured to hold the workpiece and the drive system is configured to move the carrier head to engage the workpiece with the planarizing pad, and the carrier head and/or the table is movable relative to the other to rub the workpiece against the planarizing pad.

21. The polishing machine of claim 20 wherein the first groove is configured to flow the solution into the retaining ring when the retaining ring rotates in the first direction.

22. The polishing machine of claim 20 wherein the second groove is configured to flow the solution into the retaining ring when the retaining ring rotates in the second direction.

23. The polishing machine of claim 20 wherein the first groove is at least substantially transverse to the second groove.

24. The polishing machine of claim 20 wherein the retaining ring is configured to exhaust the solution when the retaining ring rotates in the first direction and the retaining ring is configured to exhaust the solution when the retaining ring rotates in the second direction.

25. A polishing machine for mechanical or chemical-mechanical polishing of micro-device workpieces, comprising:

a table having a support surface;

a planarizing pad coupled to the support surface of the table; and a workpiece carrier assembly including a carrier head with a retaining ring and a drive system coupled to the carrier head, the retaining ring including an inner surface, an outer surface, a first surface between the inner surface and the outer surface, a means for pumping the solution through the retaining ring, and a means for concurrently exhausting the solution through the retaining ring as the retaining ring rotates in the a single direction, wherein the means for pumping comprises a first channel and the means for exhausting comprises a second channel intersecting the first channel proximate to the outer surface, wherein the carrier head is configured to hold the workpiece and the drive system is configured to move the carrier head to engage the workpiece with the planarizing pad, and the carrier head and/or the table is movable relative to the other to rub the workpiece against the planarizing pad.

26. A method of polishing a micro-device workpiece, comprising:

retaining the workpiece with a retaining ring;

rotating the retaining ring relative to a polishing pad in a first direction;

passing a solution through at least a first groove in the ring having a first orientation in the retaining ring; and exhausting the solution through at least a second groove in the ring having a second orientation at least substantially transverse to the first orientation in the retaining ring, wherein the second groove intersects the first groove proximate to an outer surface of the retaining ring.

27. The method of claim 26 wherein passing a solution through the first groove comprises causing the solution to move through at least the first groove due to the orientation of the at least first groove proximate to a leading edge of the retaining ring.

28. The method of claim 26 wherein exhausting the solution comprises causing the solution to move through at least the second groove due to the orientation of the at least second groove proximate to a trailing edge of the retaining ring.

29. A method of manufacturing a retaining ring for retaining a micro-device workpiece, comprising:

forming a first plurality of grooves in the retaining ring at a first orientation relative to an outer surface; and making a second plurality of grooves in the retaining ring at a second orientation relative to the outer surface, wherein the second orientation is at least substantially transverse to the first orientation;

wherein making the second plurality of grooves includes creating the second plurality of grooves such that the grooves in the second plurality of grooves intersect corresponding grooves in the first plurality of grooves proximate to the outer surface.

* * * * *

UNITED STATES PATENT AND TRADEMARK OFFICE

CERTIFICATE OF CORRECTION

PATENT NO. : 6,962,520 B2
APPLICATION NO. : 10/925417
DATED : November 8, 2005
INVENTOR(S) : Theodore M. Taylor It is certified that error appears in the above-identified patent and that said Letters Patent is hereby corrected as shown below:

Column 4
Line 32, "planer" should be --planar--;

Column 7
Line 65, "channels intersects a corresponding" should be --channels intersect corresponding--;

Signed and Sealed this

Twenty-eighth Day of November, 2006

JON W. DUDAS
*Director of the United States Patent and Trademark Office*